US006074043A

United States Patent [19]

Ahn

[11] Patent Number: 6,074,043

[45] Date of Patent: Jun. 13, 2000

[54] SPRAY DEVICE FOR INK-JET PRINTER HAVING A MULTILAYER MEMBRANE FOR EJECTING INK

[75] Inventor: Byung-Sun Ahn, Suwon-si, Rep. of Korea

[73] Assignee: SamSung Electronics Co., Ltd., Suwon, Rep. of Korea

[21] Appl. No.: 08/966,535

[22] Filed: Nov. 10, 1997

[30] Foreign Application Priority Data

Nov. 8, 1996 [KR] Rep. of Korea ..... 96/52920

[51] Int. Cl.[7] ..... B41J 2/05

[52] U.S. Cl. ..... 347/54; 347/65

[58] Field of Search ..... 347/54, 63, 65, 347/70

[56] References Cited

U.S. PATENT DOCUMENTS 4,480,259 10/1984 Kruger et al. ..... 347/63
5,467,112 11/1995 Mitani ..... 347/1
5,684,519 11/1997 Matoba et al. ..... 347/54

FOREIGN PATENT DOCUMENTS 6-87213 3/1994 Japan .
8-118632 5/1996 Japan .

*Primary Examiner*—Joan Pendegrass
*Attorney, Agent, or Firm*—Robert E. Bushnell, Esq.

[57] ABSTRACT

A spray device for an ink-jet printer includes a resistor layer, selectively formed on a substrate for generating heat; a pair of electrodes, formed on the resistor layer, for supplying electrical energy to the resistor layer, a protective layer, covering the surface of the pair of electrodes and the resistor layer for preventing corrosion a heating chamber barrier, formed on the protective layer for establishing a heating chamber over the hearing portion of the resistor layer, the heating chamber containing a working fluid which is heat-expanded by the heat generated from the resistor layer; a multi-layer membrane, made up of multiple interlayers each having a different coefficient of thermal expansion, for covering the heating chamber barrier and thereby sealing the heating chamber; an ink barrier, formed on the multi-layer membrane so as to define an ink chamber for containing ink, for guiding the ink transmitted from an ink channel, a nozzle plate formed on the ink barrier and having an opening positioned over the ink chamber, for spraying ink contained in the ink chamber onto printing media; and an electrical power connection for supplying opposing polarities of electrical energy to the pair of electrodes.

22 Claims, 8 Drawing Sheets

SPRAY DEVICE FOR INK-JET PRINTER HAVING A MULTILAYER MEMBRANE FOR EJECTING INK

CLAIM OF PRIORITY

This application makes reference to, incorporates the same herein, and claims all benefits accruing under 35 U.S.C. § 119 from an application entitled Spray Device For Ink-Jet Printer earlier filed in the Korean Industrial Property Office on the Nov. 8, 1996, and there duly assigned Serial No. 52920/1996 by that Office.

BACKGROUND OF THE INVENTION

1. Field of the Invention

The present invention relates to a spray device for an ink-jet printer and, more particularly, to a spray device for achieving enhanced printer operation by using a multi-layer membrane made up of multiple interlayers each having different coefficients of thermal expansion.

2. Discussion of Related Art

An improved spraying device contrived to solve these problems is described in U.S. patent application Ser. No. 08/884,489 entitled Spray Device for InkJet Printer and a Method Thereof by Ahn Byung Sun. In this disclosure, a single-layer membrane made of a uniform material having a high heat-conductivity, e.g., Ag, Al, Cd, Cs, K, Li, Mg, Mn, Na or Zn is disclosed. Thus, though the upper portion of the membrane (that in contact with the ink chamber) and the lower portion of the membrane (that in contact with the heating chamber) have identical coefficients of thermal expansion, they have different thermal expansion rates due their adjacent materials, leaving the upper portion at a lower temperature and with a slower rate of volume variation. Therefore, the upper portion of the membrane tends to open in fissures.

Also, since there is no difference of the contracting rate with respect to the heat variation between the upper and lower portions of the membrane, the suction force of ink from the ink via to the ink chamber through the ink channel is small. Consequently, after expansion, it takes a long time for the ink to return to its original state, which affects the ink supplying speed and thus slows the overall printing speed.

SUMMARY OF THE INVENTION

Accordingly, the present invention is directed to a spray device for an ink-jet printer that substantially obviates one or more of the problems due to limitations and disadvantages of the related art.

An object of the present invention is to provide a spray device for an ink-jet printer using a multi layer membrane made up of multiple interlayers with good heat conductivity, for preventing corrosion generated by the contact of the ink with the protective layer covering the register layer and for preventing the heating layer from being damaged by the impact generated when the ink is sprayed through the openings, to thereby prolong the lifetime of the head.

Another object of the present invention is to provide a spray device for an ink jet printer, in which printing speed is enhanced by speeding up (shortening) the cycle of spraying and refilling the ink, using a multi-layer membrane made up of multiple interlayers each having a different coefficient of thermal expansion.

Additional features and advantages of the invention will be set forth in the description ,which follows and in part will be apparent from the description, or may be learned by practice of the invention. The objectives and other advantages of the invention will be realized and attained by the structure particularly pointed out in the written description and claims hereofas well as the appended drawings.

To achieve these and other advantages in, accordance with the purpose of the present invention, as embodied and broadly described, there is provided a spray device for an ink-jet printer, comprising a substrate; a resistor layer selectively formed on said substrate, for generating heat; a pair of electrodes, formed on the resistor layer, for supplying electrical energy to the resistor layer, a protective layer, covering the surfaces of the pair of electrodes and the resistor layer, for preventing corrosion; a heating chamber barrier, formed on the protective layer, for establishing a heating chamber over the heating portion of the resistor layer, the heating chamber containing a working fluid which is heat-expanded by the heat generated from the resistor layer; a multi-layer membrane made up of multiple interlayers each having a different coefficient of thermal expansion, for covering the heating chamber barrier and thereby scaling the heating chamber; an ink barrier; formed on the multi-layer membrane so as to define an ink chamber for containing ink, for guiding the ink transmitted from an ink channel; a nozzle plate formed on the ink barrier and having an opening positioned over the ink chamber, for spraying ink contained in the ink chamber onto printing media; and electrical power connection means for supplying opposing polarities of electrical energy to the pair of electrodes.

The multiple interlayers of the multi-layer membrane each have a different volume variation according to the amount of bubbles generated by a heat-expansion when the interior of the heating chamber is heated. The uppermost membrane interlayer in the multi-layer membrane has the greatest coefficient of thermal expansion and each lower membrane interlayer has a lower coefficient of thermal expansion, in sequence, such that the lowest membrane interlayer has the lowest coefficient of thermal expansion.

The spray device for an ink-jet printer of the present invention also includes a metallization layer formed between the resistor layer and the substrate, which is insulated electrically and has good heat conduction, for enhancing a suction force by cooling the heating chamber more quickly.

BRIEF DESCRIPTION OF ATTACHED DRAWINGS

A more complete appreciation of this invention, and many of the attendant advantages, thereof, will be readily apparent as the same becomes better understood by reference to the following detailed description when considered in conjunction with the accompanying drawings, in which like reference symbols indicate the same or similar components, wherein.

DETAILED DESCRIPTION OF PREFERRED EMBODIMENTS

Figure 1:
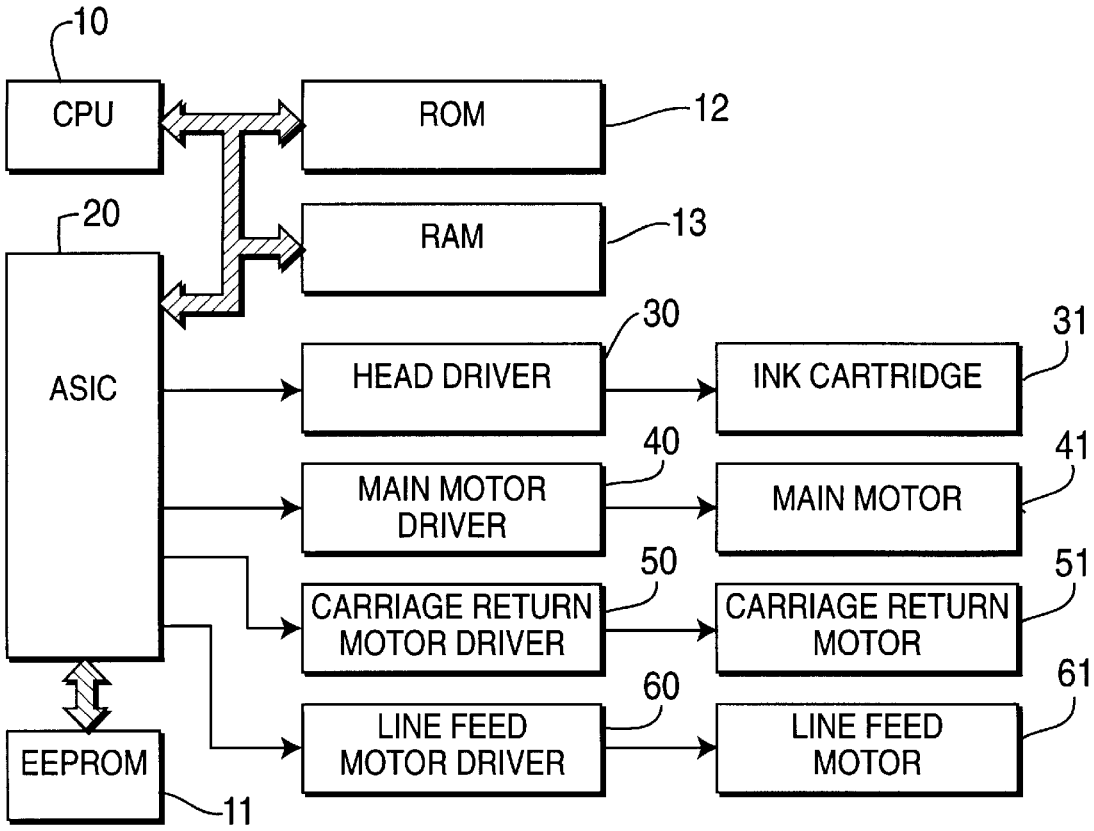
FIG. 1 is a block diagram illustrating the structure of a general ink-jet printer.

The structure and operational principle of a general ink-jet printer will be described below with reference to FIG. 1. An ink-jet printer has a CPU 10 for receiving a signal from a host computer (not shown)through its printer interface, reading a system program in an EPROM 11 that stores initial values for operating the printer and the overall system, analyzing the stored values, and outputting control signals according to the content of the program; a ROM 12 for storing a control program and several fonts; a RAM 13 for temporarily storing data during system operation, an ASIC circuit 20, which comprises most of the CPU-controlling logic circuitry, for transmitting data from the CPU 10 to the various peripheral components; a head driver 30 for controlling the operation of an ink cartridge 31 according to the control signals of the CPU 10 transmitted from the ASIC circuit 20; a main motor driver 40 for driving a main motor 41 and for preventing the nozzle of the ink cartridge 31 from exposure to air, a cartridge return motor driver 50 for controlling the operation of a carriage return motor 51; and a line feed motor driver 60 for controlling the operation of a line feed motor 61 which is a stepping motor for feeding discharging paper.

In the operation of the above apparatus, a printing signal from the host computer is applied fall through the printer interface thereof, to drive each of the motors 41, 51 and 61 according to the control signal of the CPU 10 and thus perform printing. Here, the ink cartridge 31 forms dots by spraying fine ink drops through a plurality of openings in its nozzle.

Figure 2:
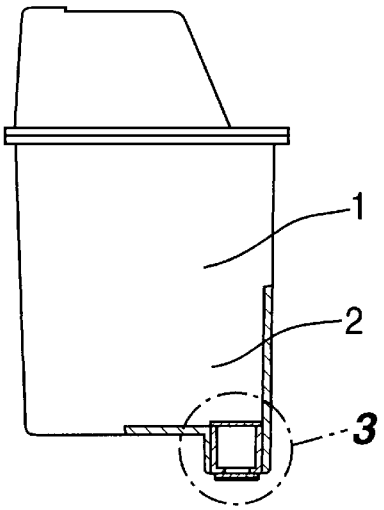
FIG. 2 is a schematic sectional view of the ink cartridge for a general ink-jet printer.
Figure 3:
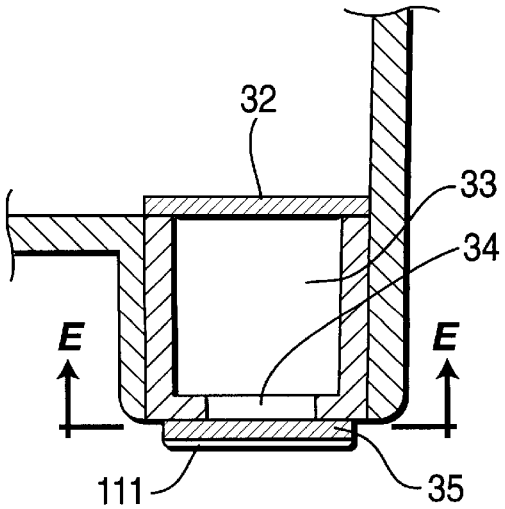
FIG. 3 is an enlarged sectional view of the head shown in FIG. 2.

The ink cartridge 31, shown FIG. 2, comprises a case 1, which forms the external profile of the cartridge, for housing a sponge-filled interior 2 for retaining the ink. Also included in the ink cartridge 31 is a head 3, shown in detail in FIG. 3, which has a filter 32 for removing impurities in. the ink; an ink stand pipe chamber 33 for containing the filtered ink; an ink via 34 for supplying ink transmitted through the ink stand pipe chamber 33 to an ink chamber (see FIG. 5) of a chip 35; and a nozzle plate 111 having a plurality of openings, for spraying ink in the ink chamber transmitted from the ink via 34 onto printing media (e.g., a sheet of paper.).

Figure 4:
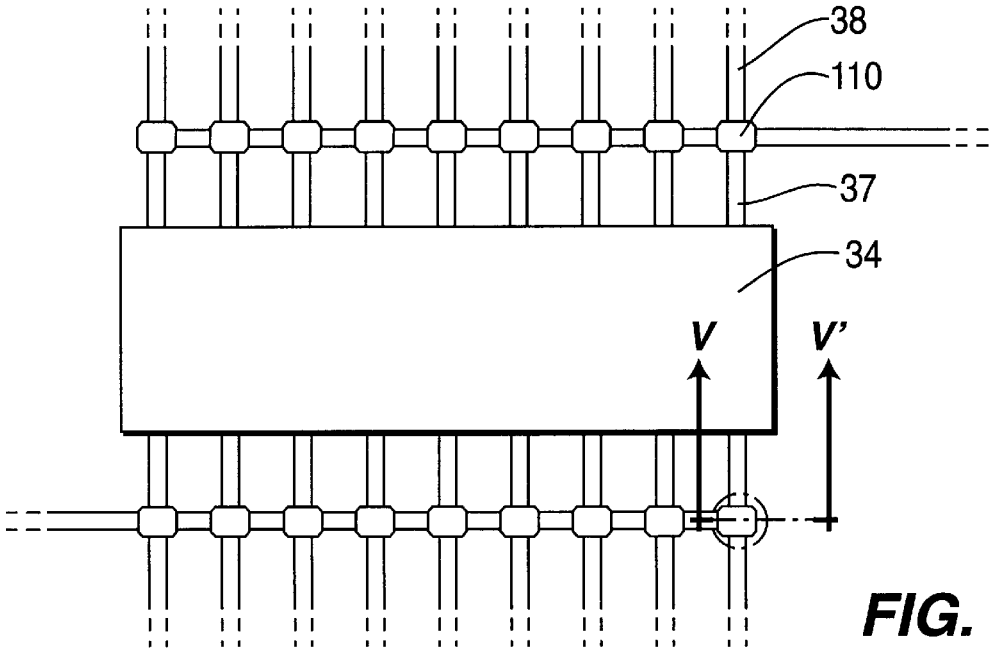
FIG. 4 is a plan view along line IV–IV' off FIG. 3.

As illustrated in FIG. 4, besides the ink via 34, the head 3 includes a plurality of ink channels 37 for supplying ink from the ink via to each opening of the nozzle plate 111; a plurality of nozzles 110 for spraying ink transmitted through the ink channels 37; and a plurality of electrical connections 38 for supplying power to the chip 35.

Figure 5:
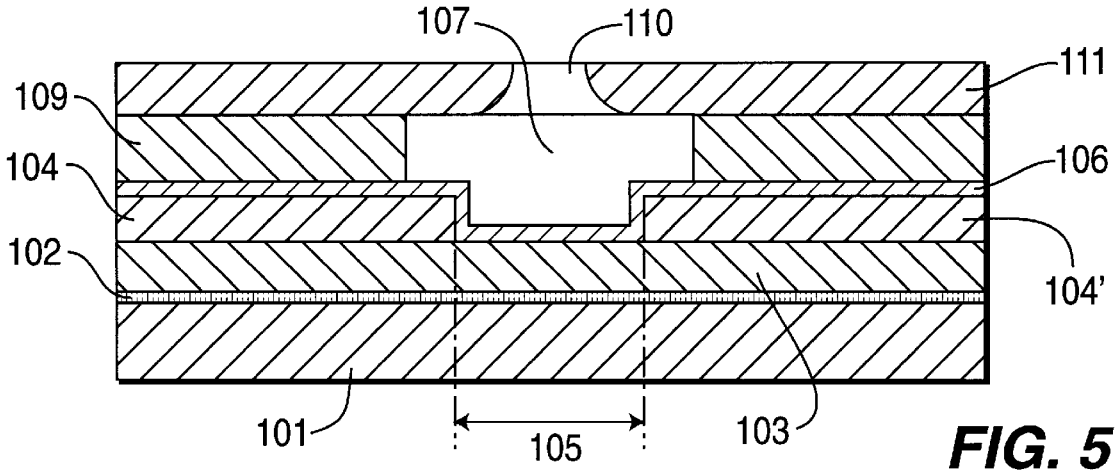
FIG. 5 is an enlarged sectional view of a conventional spray device, taken along line V–V' of FIG. 4.

As illustrated in FIG. 5, the head 3 includes a resistor layer 103 formed on a silicon dioxide ($SiO_2$) layer 102 on a silicon substrate 101 and heated by electrical energy; a pair of electrodes 104 and 104' formed on the resistor layer 103 and thus providing it with electrical energy; a protective layer 106 formed on the pair of electrodes 104 and 104' and on the resistor layer 103, for preventing a heating portion 105 from being etched/damaged by a chemical reaction an ink barrier 109 acting as a wall defining the space for flowing the ink into the ink chamber 107 and a nozzle plate 111 having an opening 110 for spraying the ink pushed out by a volume variation, i.e., the bubbles, in the ink chamber 107.

Here, the nozzle plate 111 and the heating portion 105 oppose each other with a regular spacing. The pair of electrodes 104 and 104' are electrically connected to a terminal (not shown) which is in turn connected to the head controller (FIG. 1), so that the ink is sprayed from each nozzle opening.

The thus-structured conventional ink spraying device operates as follows. The head driver 30 transmits electrical energy to the pair of electrodes 104 and 104' positioned where the desired dots are to he printed, according to the, printing control command received through the printer interface from the CPU 10. This power is transmitted for a predetermined time through the resistance elected pair of electrodes 104 and 104' and heats the heating portion 105 by electrical resistance heating (measured in joules) as determined by $P=I^2R$. The heating portion 105 is heated to 500° C.–550° C., and the heat conducts to the protective layer 106 thereon. Here, when the heat is applied to the ink directly wetting the protective layer, the distribution of the bubbles generated by the resulting steam pressure is highest in the center of the heating portion 105 and symmetrically distributed (see FIG. 6). The ink is there-by heated and bubbles are formed, so that the volume of the ink on the heating portion 105 is changed by the generated bubbles. The ink pushed out by the volume variation is expelled through the opening 110 of the nozzle plate 111.

At this time, if the electrical energy supply to the electrodes 104 and 104' is cut off, the heating portion 105 is momentarily cooled and the expanded bubbles are accordingly contracted, thereby returning the ink to its original state.

The ink thus expanded and discharged out through the openings of the nozzle plate is sprayed onto the printing media in the form of a drop, forming an image thereon due to surface tension. In doing so, internal pressure is decreased in accordance with the volume of the corresponding bubbles discharged, which causes the ink chamber to refill with ink from the container through the ink via.

However, the above-mentioned conventional ink spraying device has several problems. First, since bubbles are formed in the ink by high-temperature heating and the ink itself exhibits a thermal variation, the lifetime of the head is decreased due to in impact wave from the bubbles. Second, the ink and the protective layer 106 react electrically with each other, resulting in corrosion due to migrating ions from the interface of the heating portion 105 and the electrodes 104 and 104', which thereby further decreases the lifetime of the head. Third, the influence of bubbles being formed in the ink chamber containing ink increases the ink chamber's recharging time. Fourth, the shape of the bubbles affects the advance, circularity and uniformity of the ink drop, which therefore affects printing quality.

Figure 7:
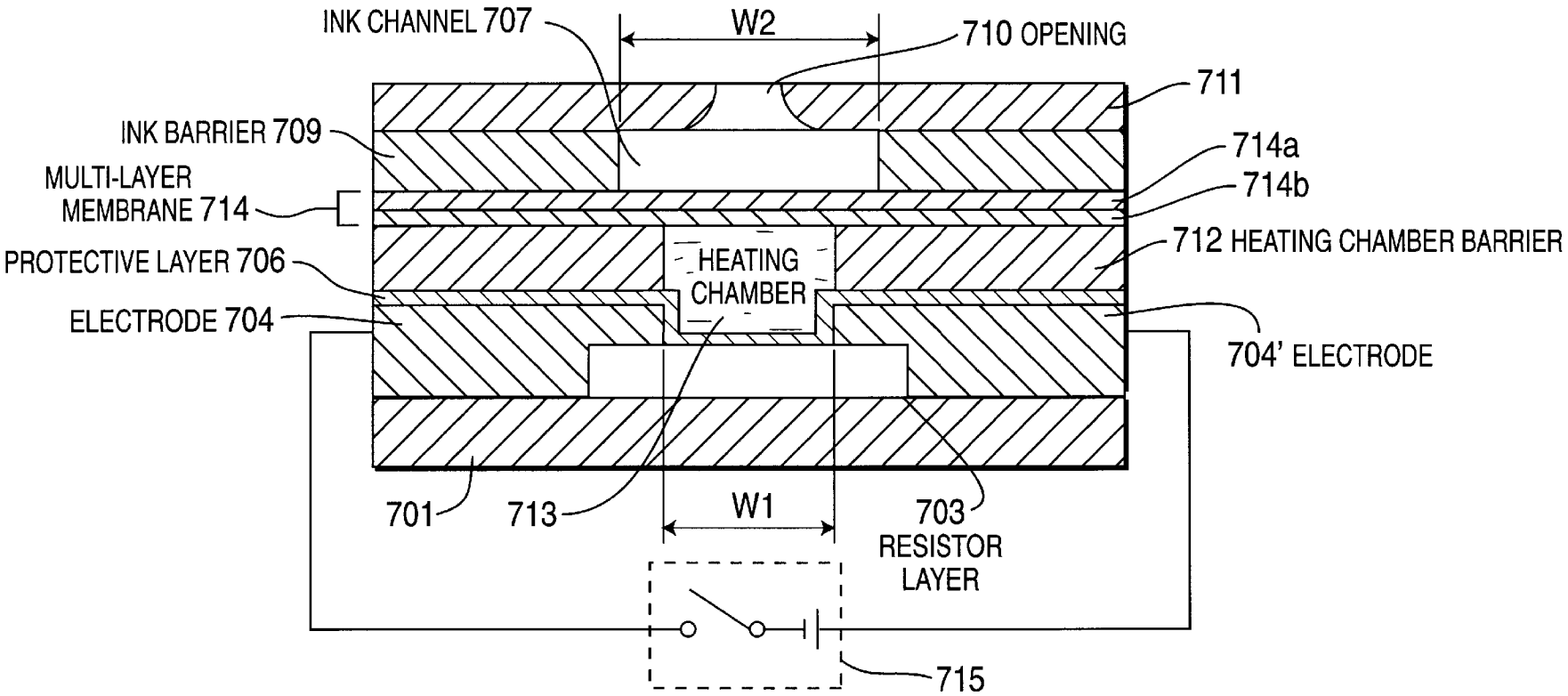
FIG. 7 is a sectional view of a spray device for an ink-jet printer according to the present invention.

As shown in FIG. 7, a spray device for an ink-jet printer according to the present invention includes: a resistor layer 703 formed on a substrate 701; a pair of electrodes 704 and 704', formed on the resistor layer 703, for supplying electrical energy of opposing polarities; a protective layer 706 for preventing the surfaces of the pair of electrodes 704 and 704' and the resistor layer 703 from corrosion; a heating chamber barrier 712, formed on the protective layer 706, for establishing a predetermined space over the heating portion of the resistor layer 703, a heating chamber 713, formed by the heating chamber barrier 712, for containing a working fluid which is heat-expanded by the heat generated from the resistor layer 703; a multi-layer membrane 714, made up of multiple interlayers each with differing coefficients of thermal expansion, for covering the heating chamber barrier 712 and thereby sealing the heating chamber 713; an ink barrier, formed on the multi-layer membrane so as, to define an ink chamber for containing ink, for guiding the ink- transmitted from an ink channel 707; a nozzle plate 711 formed on the ink barrier 709 and the ink chamber 707 and having a plurality of openings 710 for spraying the ink in the ink chamber 707 onto media; and electrical power connection means 715 for supplying opposing polarities of electrical energy to the pair of electrodes 704 and 704'.

The individual layers in the multi-layer membrane 714 have differing volume variations according to the amount of bubbles generated by a heat-expansion during the heating of the interior of the heating chamber 713, because each layer of the multi-layer membrane 714 has a different coefficient of thermal expansion. That is, the uppermost membrane interlayer in the multi-layer membrane has the greatest coefficient of thermal expansion and each lower membrane interlayer has a lower coefficient of thermal expansion, in sequence, such that the lowest membrane interlayer has the lowest coefficient of thermal expansion.

The exposed, the working area W2 of the upper membrane interlayer 714*a* of the multi-layer membrane 714 is greater than the working area (W1) of the lowest membrane interlayer. The multi-layer membrane 714 preferably has a thickness of 1 $\mu$m to 3 $\mu$m. The working fluid in the heating chamber 713 can be a liquid, a gas (e.g., air), or a mixture of gas and liquid.

Figure 6:
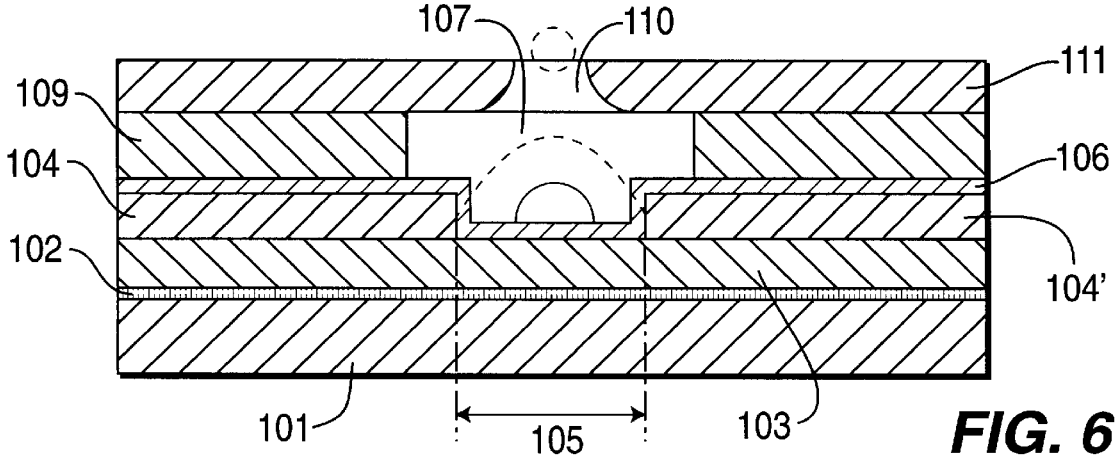
FIG. 6 is a view of the spray device of FIG. 5, for illustrating its operation.

Contrary to the earlier spray device illustrated in FIG. 5 and FIG. 6, in the present invention, the multi-layer membrane 714 separates the heating chamber 713 from the ink chamber 707, to solve the earlier problems resulting from the ink being heated directly from the heating portion. Thus, the corrosion generated from the contact of the ink and the resistor layer 1, prevented, and the resistor layer is protected from the effects of bubble generation.

Figure 9:
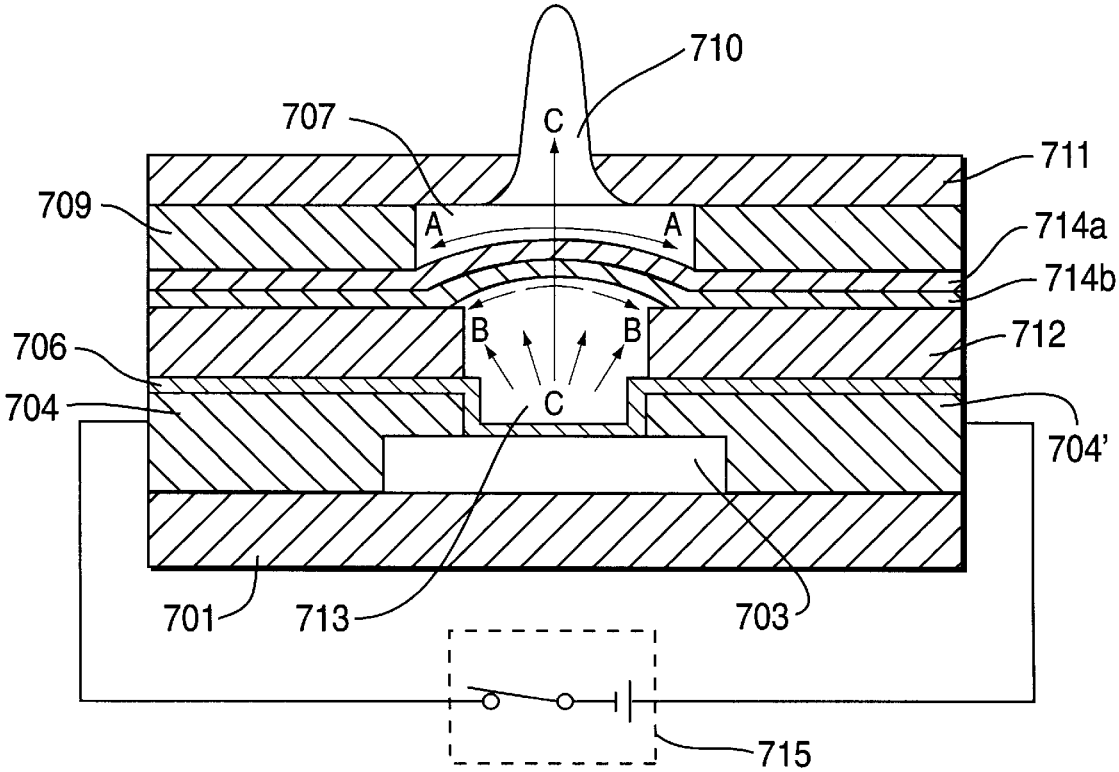
Figure 10:
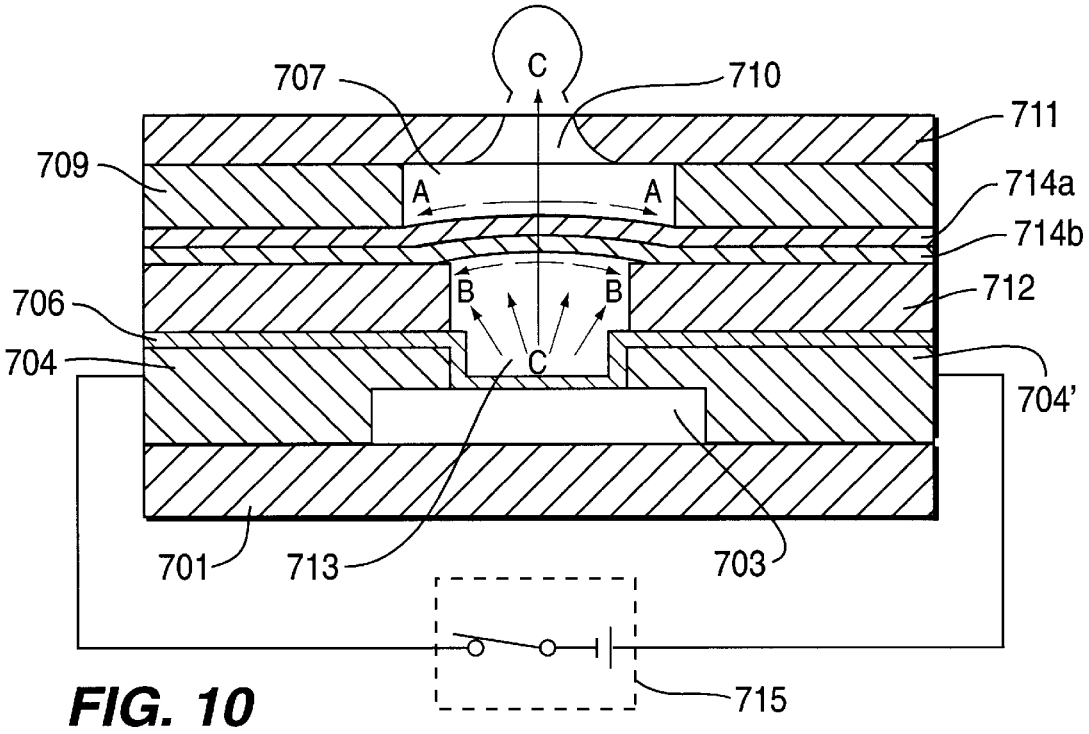
Figure 11:
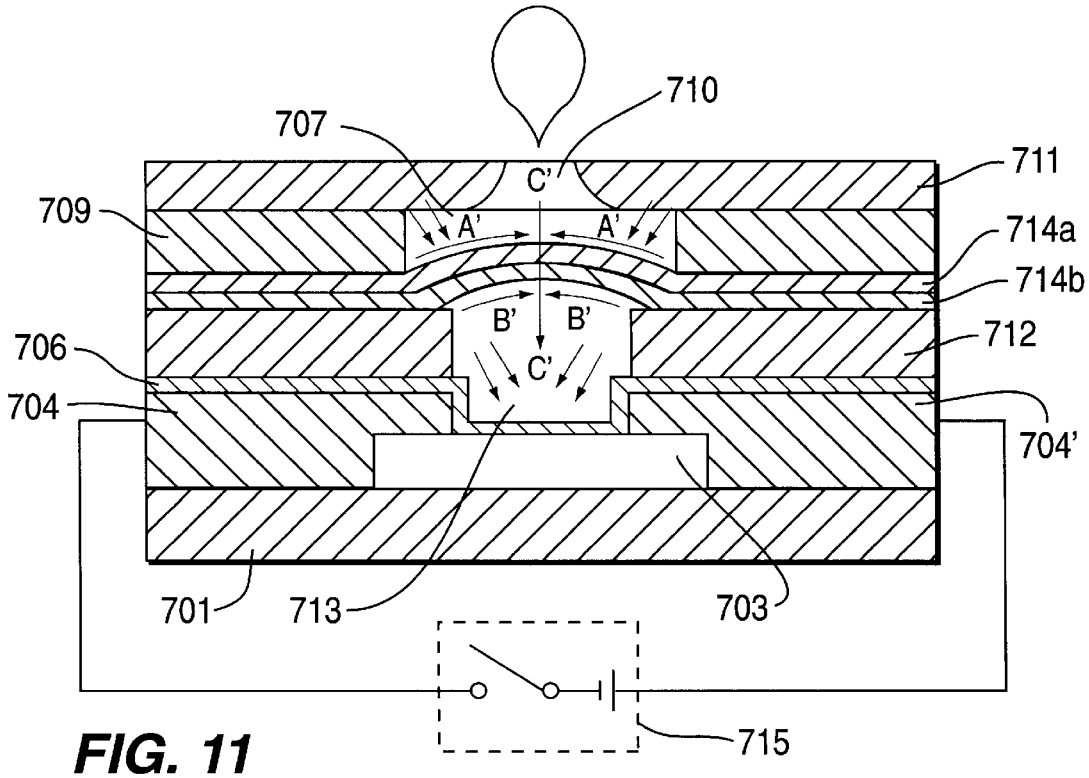
Figure 12:
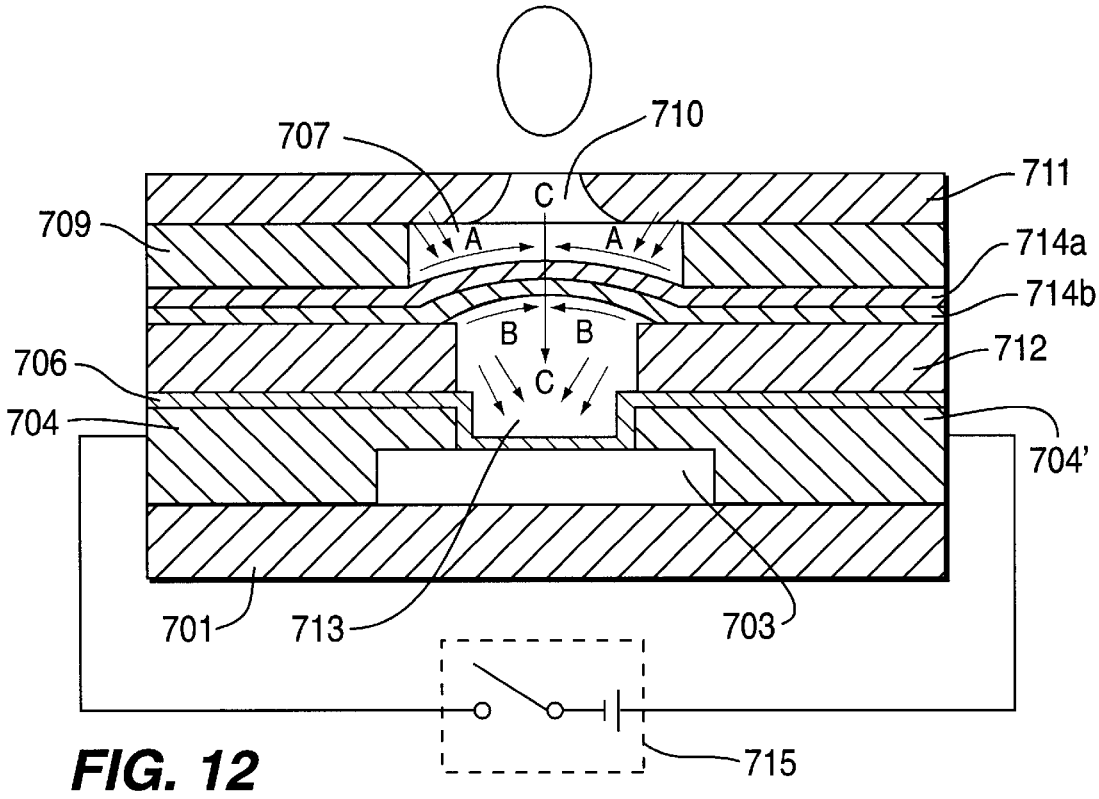
Figure 13:
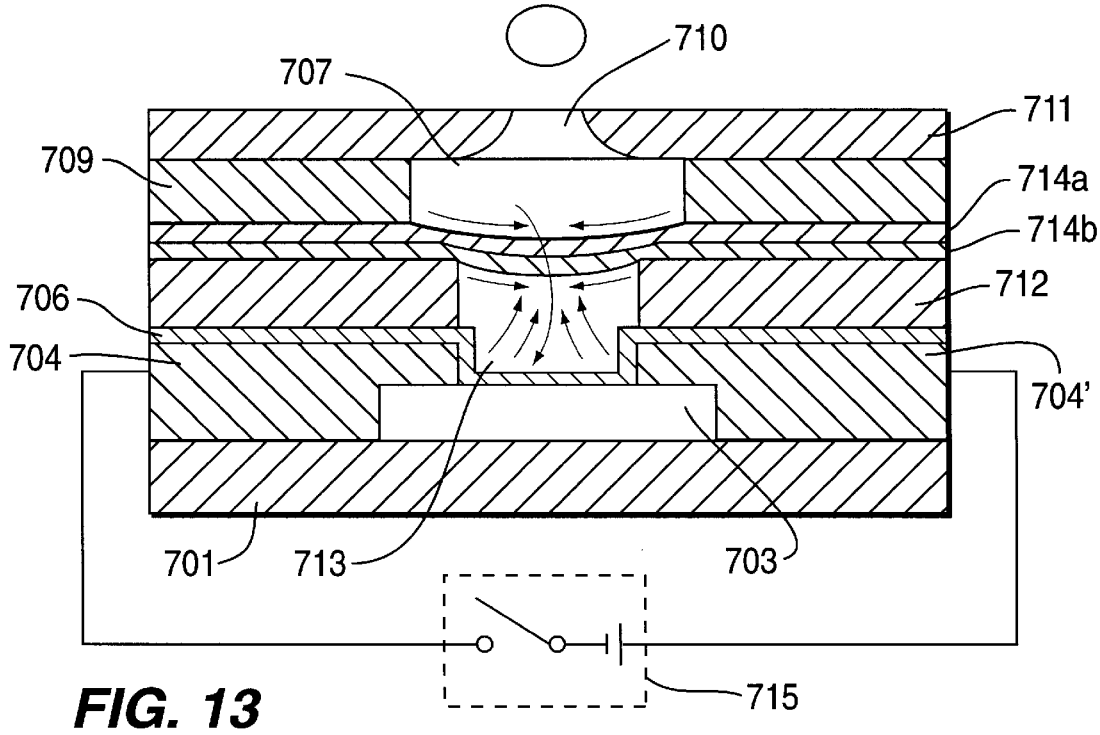

Now, the operation of the present invention having the above structure will be described with reference to FIGS. 8–13 in which electrical power connection means 715 is shown connected across the pair of electrodes 704 and 704'. Here, FIGS. 8, 9 and 10 illustrate an energized state (power applied) and FIGS. 11, 12 and 13 illustrate a de-energized state (power interrupted).

To print a dot of ink on a desired position of print media, the head driver 30 supplies an electrical signal to the corresponding electrode pair via the electrical power connection means 715, such that opposing polarities are respectively applied to the electrodes 704 and 704'. Heat is generated in the resistor layer 703 by the supplied electrical energy, which thermally expands the working fluid in the heating chamber 713 due to thermionic conduction and convection. This heat is transferred through the working fluid in the heating chamber 713 to the multi-layer membrane 714. Accordingly, each of the interlayers in the multi-layer membrane 714 is expanded according to the amount of bubbles generated by a heat-expansion when the interior of the heating chamber 713 is heated. Due to its higher coefficient of thermal expansion, the upper membrane interlayer 714*a* undergoes greater thermal expansion than does the lower membrane interlayer 714*b*, even though the temperature of the lower membrane interlayer, being in direct contact with the heating chamber 713 is higher than that of the upper membrane interlayer which is in contact with the ink in the ink chamber 707.

Figure 8:
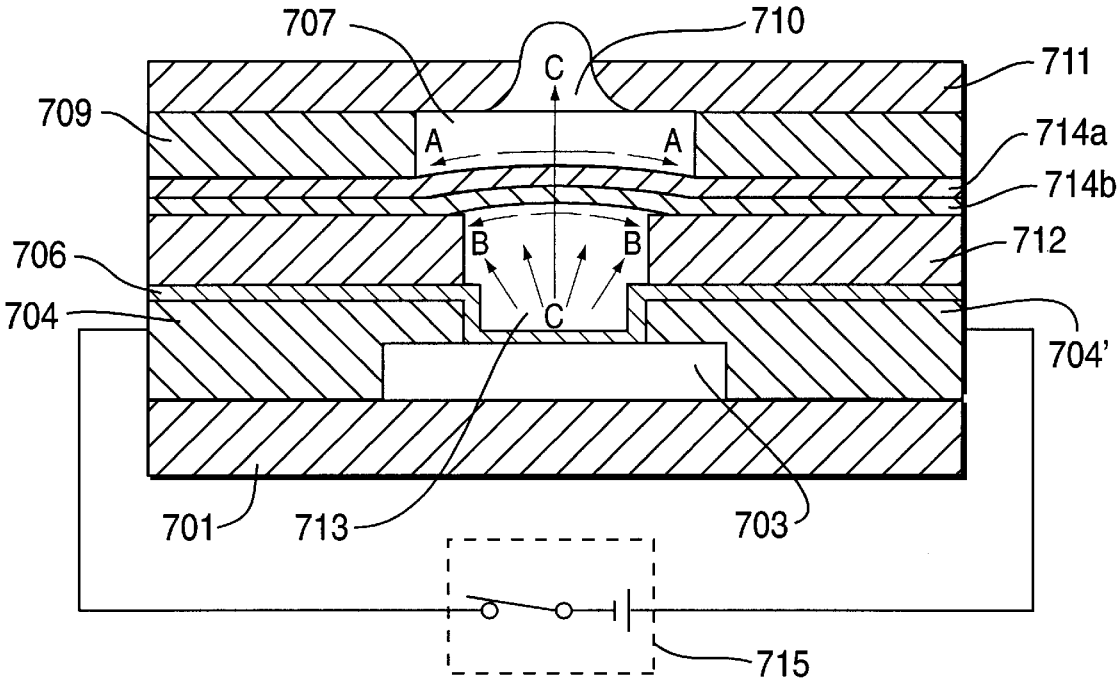
FIGS. 8–13 illustrate the operation of the present invention in accordance with an applied electrical signal.

In FIG. 8, the thermal expansive force (represented by arrow A) of the upper membrane interlayer 714*a* results from the heat transmitted from the ink-chamber 707, and the thermal expansive force (represented by arrow B) of the lower membrane interlayer 714*b* results from the heat transmitted from the heating chamber 713. Thus, the thermal expansive force exerted on the upper membrane interlayer 714*a* is greater than that exerted on the lower membrane interlayer 714*b*.

The steam pressure which is thermally expanded in the sealed space of the heating chamber 713 is greater than the steam pressure in the ink chamber 707, making the thermal expansion rate of the upper membrane interlayer 714*a* the greater, to thereby create an upward perpendicular force (represented by arrow C) on the membrane layer 714. The thus-deformed multi-layer membrane 714 starts pushing the ink in the ink chamber 707 through the opening 710 of the nozzle plate 711.

As illustrated in FIG. 9, the multi-layer membrane 714 is stretched further, as the expansion of the heating chamber 713 continues. Thus, the ink in the ink, chamber 707 is gradually pushed through the opening 710 of the nozzle plate 711.

FIG. 10 illustrates the moment when the spray device sprays ink from the opening 710, as the thermal expansion of the heating chamber 713 reaches saturation.

In FIG. 11, with the power to electrodes 704 and 704' cut off, the working fluid in the heating chamber 713 starts contracting, and the drop pushed out the opening 710 becomes separated from the nozzle plate 711, being expelled toward the printing media. At this time, each of the interlayers in the multi-layer membrane 714 is cooled and contracted, but at a different rate due to their differing coefficients of thermal expansion. That is, the upper membrane interlayer 714*a* having the highest coefficient of thermal expansion contracts the most while the lower membrane interlayer 714*b* having the lowest coefficient of thermal expansion contracts the least.

Here, the contractile force of the upper membrane interlayer 714*a* is represented by arrow A' and the contractile force of the lower membrane interlayer 714*b* is represented by arrow B'. The difference of the contractile rate between each interlayer in the multi layer membrane 714 creates a downward perpendicular force (represented by arrow C') on the multi-layer membrane. After the cut-off of the electrical energy provided to the electrodes 701 and 704', the contraction of the upper membrane interlayer 714*a* occurs rapidly and the contraction of the lower membrane interlayer 714*b* occurs more slowly.

The ink drop becomes fully detached from the opening 710 of the nozzle plate 711 and forms into an oblong shape as in FIG. 12.

As illustrated in FIG. 13, since the contractile force exerted on the upper membrane interlayer 714*a* is greater than that exerted on the lower membrane interlayer 714*b*, the multi-layer membrane 714 is quickly forced inward, i.e., toward the heating chamber 713, which is called buckling Therefore, a suction force is generated in the ink chamber 713 which is thus refilled with ink. Accordingly, the ink drop separated from the opening 710 due to the surface tension forms into a spherical shape for spraying onto printing media.

Figure 14:
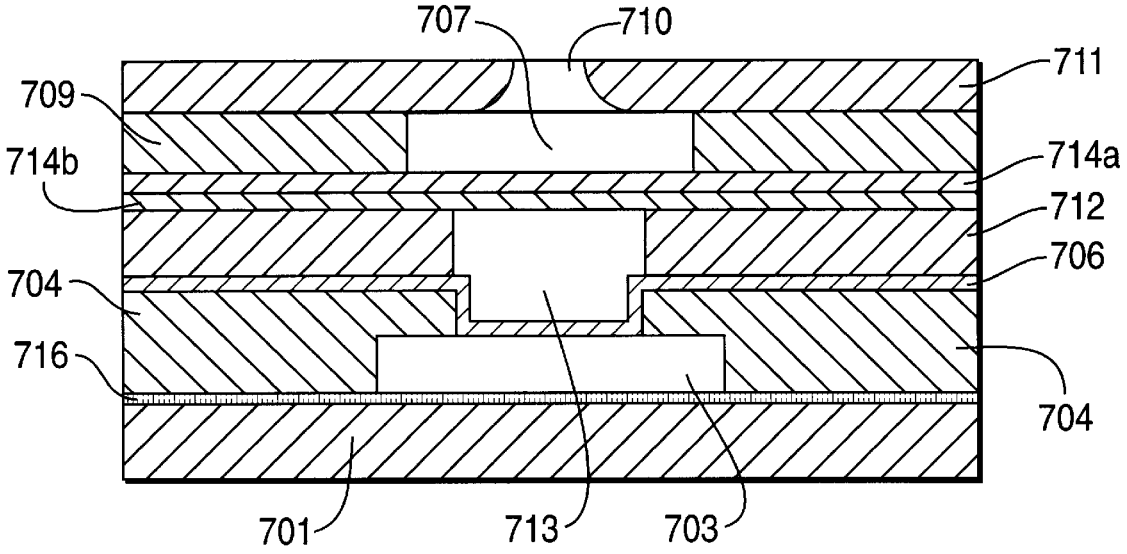
FIG. 14 is a sectional view of the preferred embodiment of a spray device for an ink-jet printer according to the present invention.

As illustrated in FIG. 14, the cooling speed of the heat in the heating chamber 713 can be increased by the addition of a metallization layer 716 having good heat conductivity, which causes the multi-layer membrane 714 to cool more quickly and thus enhances the buckling operation. The metallization layer 716 is formed directly on the substrate 701 under the resistor layer 703 and is electrically insulated from the resistor layer and the electrodes 704 and 704'.

Figure 15:
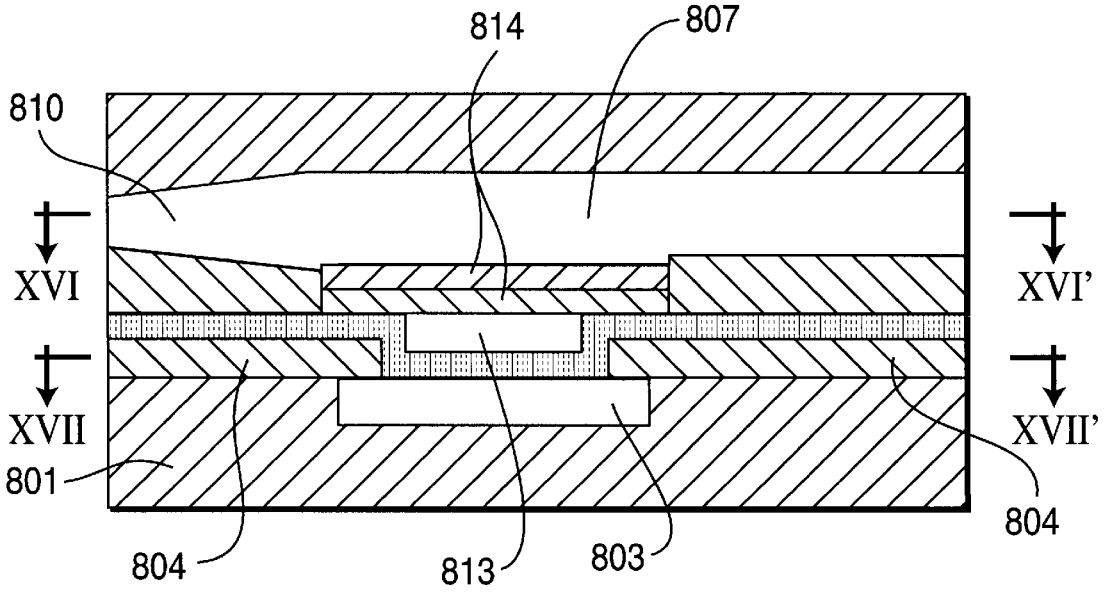
FIG. 15 is another embodiment of a spray device for an ink-jet printer according to the present invention.
Figure 16:
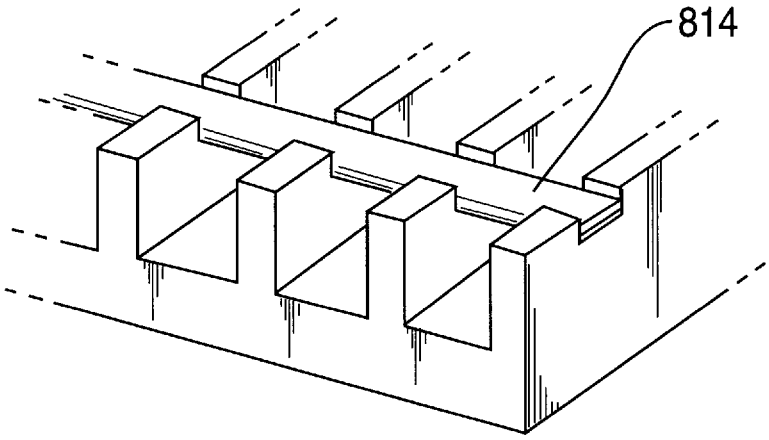
FIG. 16 is a perspective cut-away view along line XVI–XVI' in FIG. 15, showing several ink channels.
Figure 17:
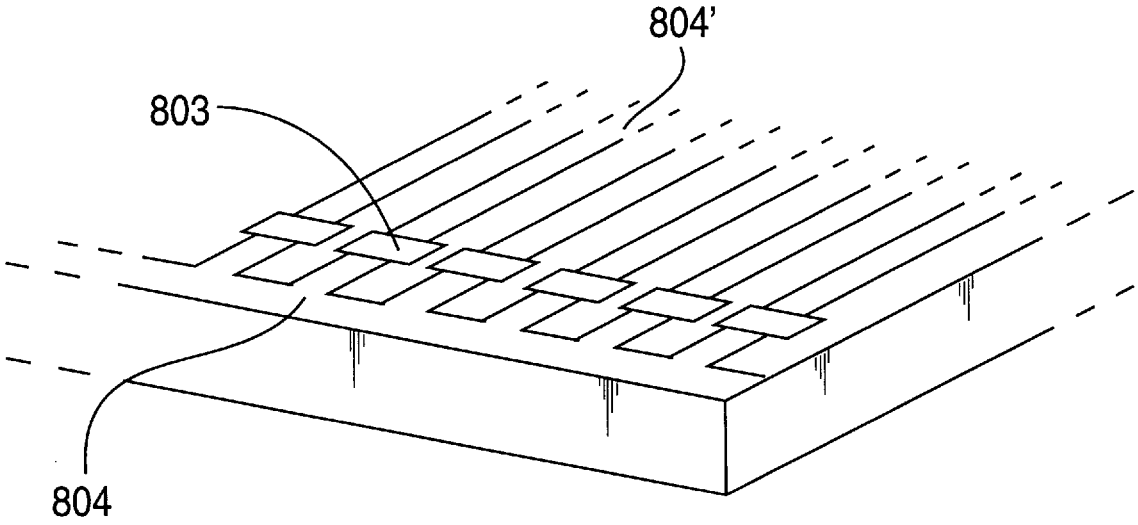
FIG. 17 is a perspective cut-away, view along line XVI-I–XVII' in FIG. 15, showing several ink channels.

FIG. 15 shows another embodiment of the present invention, in which the nozzle is repositioned with respect to the heating chamber. FIG. 15 shows resistor layer 803 built upon substrate 801. Electrodes 804 and 804' are situated on top of substrate 801 and are in connection with resistive layer 803. Heating chamber 813 is situated between resistive layer 803 and flexible membrane 814. Ink channel 807 is situated on the opposite site of flexible membrane 814 and gives way to opening 810. FIG. 16 and FIG. 17 are perspective cut-away views of FIG. 15, along lines XVI–XVI' and XVII–XVII', respectively.

In FIG. 16, a multi-layer membrane 814 is made up of multiple interlayers each having a different coefficient of thermal expansion, as in the case of the device of FIG. 7.

FIG. 17 shows a pair of electrodes 804 and 804' (one being a common electrode) and a plurality of resistor layers 803 to heat the heating chambers in the same manner as described with respect to the electrical power connection means 715 of the first embodiment.

As described above, the present invention controls the thermal expansion and contraction of a multi-layer membrane made up of multiple interlayers each having a different coefficient of thermal expansion, ink is sprayed according to the deformation of the multi-layer membrane, thereby resulting in high-speed printing.

It will be apparent to those skilled in the art that various modifications can he made in the spray device for an inkjet printer of the present invention, without departing from the spirit of the invention. Thus, it is intended that the present invention cover such modifications as well as variations thereof within the scope of the appended claims.

What is claimed is:

1. A spray device for an ink-jet printer, comprising:

a substrate;

a resistor layer, selectively formed on said substrate, for generating, heat;

a pair of electrodes, formed on said resistor layer, for supplying electrical energy to said resistor layer;

a heating chamber barrier, for establishing a heating chamber over said resistor layer, the heating chamber containing a working fluid which is heat-expanded by the heat generated by said resistor layer;

a flexible multi-layer membrane having a plurality of flexible and coextensive interlayers, for covering said heating chamber barrier and thereby sealing the heating chamber;

an ink barrier formed on said flexible multi-layer membrane so as to define an ink chamber for containing ink, for guiding the ink transmitted from an ink channel;

a nozzle plate formed over said ink barrier, said nozzle plate having an opening positioned above said ink chamber, for spraying ink contained in the ink chamber onto a printing media; and electrical power connection means for supplying opposing polarities of electrical energy to said pair of electrodes.

2. The device as claimed in claim 1, wherein each one of said plurality of flexible and coextensive interlayers of said flexible multi-layer membrane has a different coefficient of thermal expansion.

3. The device as claimed in claim 2, wherein said plurality of interlayers of said flexible multi-layer membrane comprises:

an uppermost flexible membrane interlayer formed adjacent to said ink barrier; and a lowermost flexible membrane interlayer formed adjacent to said heating chamber barrier and said heating chamber, wherein said uppermost flexible membrane interlayer has a higher coefficient of thermal expansion than said lowermost flexible membrane interlayer.

4. The device as claimed in claim 3, wherein a working area of the uppermost flexible membrane interlayer in said multi-layer membrane is greater than that of the lowermost flexible membrane interlayer.

5. The device as claimed claim 1, where said multi-layer membrane comprises two interlayers.

6. The device as claimed in claim 1, wherein said multi-layer membrane has a thickness between 1 $\mu$m and 3 $\mu$m.

7. The device as claimed in claim 1, wherein each one of said plurality of flexible and coextensive interlayers of said flexible multi-layer membrane has a different and unique contracting rate.

8. The device its claimed in claim 1, wherein the working fluid of said heating chamber is one of a liquid, a gas, and a mixture of liquid and gas.

9. The device as claimed in claim 8, wherein the gas is air.

10. The device as claimed in claim 1, further comprising a metallization layer formed between said resistor layer and said substrate.

11. A spray device for an ink-jet printer, comprising:

a substrate;

a pair of electrodes placed on said substrate;

a heating resistor placed on said substrate between said pair of electrodes;

a heating chamber barriers placed over said pair of electrodes;

a heating chamber formed over said heating resistor and between said heating chamber barriers, said heating chamber having a first width;

a plurality of flexible membrane layers placed over the combination of said heating chamber barriers and said heating chamber, sealing in said heating chamber;

ink barriers placed over said plurality of flexible membrane layers;

an ink channel formed between said ink barriers and adjacent to said plurality of flexible membrane layers, said ink channel having a second width; and a nozzle plate formed over said ink barriers and having an opening narrower than said second width.

12. The spray device of claim 11, said second width being greater than said first width.

13. The spray device of claim 11, wherein a charging circuit forms a potential difference between said pair of electrodes.

14. The spray device of claim 11, said heating chamber being filled with air.

15. The spray device of claim 11, said ink channel being filled with ink.

16. The spray device of claim 11, wherein said heating resistor heats said heating chamber, causing said heating chamber to expand, causing said plurality of flexible membrane layers to bulge towards said opening in said ink barrier.

17. The spray device of claim 16, wherein said plurality of flexible membrane layers contains a top layer nearest to said opening in said ink barrier, and a lowest layer located adjacent to said heating chamber, said top layer bulges more than said lowest layer upon heating said heating resistor.

18. The spray device of claim 17, wherein a drop of ink is expelled through said opening of said nozzle plate upon said heating of said heating resistor because of said bulging of said plurality of flexible membrane layers.

19. The spray device of claim 11, wherein said plurality of flexible membrane layers comprises an uppermost membrane layer formed adjacent to said ink barrier and a lowermost membrane layer formed adjacent to said heating chamber barriers and said heating chamber, said uppermost membrane layer has a higher coefficient of thermal expansion than said lowermost membrane layer.

20. A spray device for an ink-jet printer, comprising:

a substrate;

a pair of electrodes placed on said substrate;

a heating resistor placed on said substrate between said pair of electrodes;

a protective layer formed over said heating resistor and said pair of electrodes;

a plurality of flexible membrane layers placed over the combination of said protective layer and said heating chamber, sealing in said heating chamber while only covering portions of said protective layer adjacent to said heating chamber;

working fluid disposed within said heating chamber, said working fluid expands and contracts respectively in response to the application and removal of heat from said heating resistor, causing said plurality of flexible membrane layers to flex in an upward direction and contract in a downward direction with respect to said heating chamber;

a pair of ink barriers placed to the left and the right of said plurality of flexible membrane layers over portions of said protective layer not covered by said plurality of flexible membrane layers; and an ink channel formed between the combination of said ink barriers and said plurality of flexible membrane layers and a top cover, said ink channel being filled with ink, said ink channel forming an opening at one of said right or said left of said plurality of flexible membrane layers between one of said pair of ink barriers and said top cover, allowing ink to expel from said spray device in a direction transverse from said direction said plurality of flexible membrane layers expand and contract upon application of heat to said heating resistors.

21. The spray device of claim 20, wherein said plurality of flexible membrane layers comprises a top layer nearest to said ink channel, and a lowest layer located adjacent to said heating chamber, said top layer bulges more than said lowest layer upon heating said heating resistor.

22. The spray device of claim 20, wherein said plurality of flexible membrane layers comprises a top layer nearest to said ink channel and a lowest layer located adjacent to said heating chamber, said top layer having a higher coefficient of thermal expansion than said lowest layer.

* * * * *